US007922621B1

(12) United States Patent
Hamada et al.

(10) Patent No.: US 7,922,621 B1
(45) Date of Patent: Apr. 12, 2011

(54) PHYSICAL EXERCISE CONDITION DETECTING APPARATUS OF MUSCLE FORCE TRAINING MACHINE

(75) Inventors: Kazuyuki Hamada, Hachioji (JP); Yoshihisa Ujima, Hachioji (JP); Tsutomu Nishizawa, Hachioji (JP)

(73) Assignee: System Instruments Co., Ltd., Tokyo (JP)

( * ) Notice: Subject to any disclaimer, the term of this patent is extended or adjusted under 35 U.S.C. 154(b) by 0 days.

(21) Appl. No.: 12/923,417

(22) Filed: Sep. 21, 2010

(30) Foreign Application Priority Data

Sep. 25, 2009 (JP) ..... 2009-220014

(51) Int. Cl.
*A63B 71/00* (2006.01)

(52) U.S. Cl. ..... 482/8; 482/1; 482/92; 482/98

(58) Field of Classification Search ..... 482/1–9, 482/51–53, 70, 111–113, 120, 900–902, 482/92, 10, 98
See application file for complete search history.

(56) References Cited

U.S. PATENT DOCUMENTS 4,659,077 A * 4/1987 Stropkay ..... 482/70
6,027,429 A * 2/2000 Daniels ..... 482/5
7,361,122 B2 * 4/2008 Porth ..... 482/52

* cited by examiner

*Primary Examiner* — Glenn Richman
(74) *Attorney, Agent, or Firm* — Bacon & Thomas, PLLC

(57) ABSTRACT

In order to measure a physical exercise condition data at a time of pre-testing and a muscle force training to accumulate and indicate them together with various set data, a muscle force training machine having a training apparatus main body and a training load applying apparatus is provided with a rotation detecting sensor which detects a rotating direction and an amount of rotation of a main shaft within the training load applying apparatus, and a data processing apparatus which stores the rotating direction and the amount of rotation from the rotation detecting sensor together with set data at least including a load amount, various body condition information of a training person and other data necessary for measuring in a data base, and processes them to make indicative data in forms of display data, print data and the like.

1 Claim, 6 Drawing Sheets

PHYSICAL EXERCISE CONDITION DETECTING APPARATUS OF MUSCLE FORCE TRAINING MACHINE

BACKGROUND OF THE INVENTION

1. Field of the Invention

The present invention relates to a physical exercise condition detecting apparatus of a muscle force training machine which is preferably used for an aged person, a rehabilitation exercise after an illness, or the like, and more particularly to a physical exercise condition detecting apparatus of a muscle force training machine which can measure a physical exercise condition data at a time of testing before starting a muscle force training and doing the muscle force training and can accumulate and indicate them together with various set data.

2. Description of the Conventional Art

A toe training apparatus has been proposed as one of modification examples of a muscle force training apparatus. The toe training apparatus is structured such that a roller is provided in a base plate on which a foot is mounted, and the roller can be rotated by a toe mounted on the base plate, is also structured such that a rotating state of the roller is detected by a detection portion, and the data detected by the detect ion portion can be di splayed by a di splay portion, and is further structured such that a load preventing the roller from rotating is applied by a load applying mechanism (Japanese Unexamined Patent Publication No. 2000-210393).

Thus, an original motive function of the toe can be recovered without hardship and securely by mounting the foot on the base plate and rotating the roller by the toe. Further, the conventional toe training apparatus is structured such that the rotating condition of the roller can be displayed by the display portion, and an accurate and objective data can be displayed and provided.

SUMMARY OF THE INVENTION

Problem to be Solved by the Invention

However, although the conventional toe training apparatus has such an advantage that it can recover the original motive function of the toe without hardship and securely, and can detect the rotating condition of the roller by the detection portion so as to display and provide it via the display portion, yet, there is such a defect that it can not be used for training another part of the body.

On the other hand, in the conventional muscle force training machine, record and the like of the physical exercise condition at a time of training is made manually, the physical exercise condition data themselves are viewed and evaluated by a person, and there has not been proposed a structure in which the physical exercise condition data are objectively measured so as to be displayed or indicated. Accordingly, since the conventional muscle force training machine can neither accurately and quantitatively measure nor store the physical exercise condition data, there is a defect of causing a physical burden of a trainer or a helper who increases and decreases a small amount of load finely, for example, in a load determination test, and a mental burden, for example, of worrying about a mistake.

The present invention is made by taking the point mentioned above into consideration, and an object of the present invention is to provide a physical exercise condition detecting apparatus of a muscle force training machine which can measure a physical exercise condition data at a time of testing before starting a muscle force training and executing the muscle force training, and can accumulate and indicate them together with various set data.

Means for Solving the Problem

Thus, in accordance with the present invention, there is provided a physical exercise condition detecting apparatus of a muscle force training machine comprising:

a training apparatus main body; and a training load applying apparatus having a main shaft which is arranged horizontally within a base frame and is supported rotatably in a vertical direction, load weight pulleys which apply a load to the main shaft, a load transmitting pulley which fastens a base end of a load transmitting cable body, is firmly attached to an end portion of the main shaft and has the same diameter as those of the load weight pulleys, and load weights which are connected to respective distal ends of load weight coupling cable bodies fastened by their base ends to the load weight pulleys and wound in an opposite direction to the load transmitting cable body, and applying a load to the training apparatus main body via the load transmitting cable body, wherein the physical exercise condition detecting apparatus comprises:

a rotation detecting sensor which is provided in the vicinity of the main shaft within the training load applying apparatus, and is capable of detecting a rotating direction and an amount of rotation of the main shaft; and a data processing apparatus which takes in the rotating direction and the amount of rotation from the rotation detecting sensor, stores the taken in rotating direction and amount of rotation together with set data at least including a load amount, various body condition information of a training person and other data necessary for measuring, in a data base, and processes them to make indicative data in forms of display data, print data and the like on the basis of the various set data from the data base.

EFFECT OF THE INVENTION

In accordance with the physical exercise condition detecting apparatus of the muscle force training machine on the basis of an embodiment of the present invention, since it is structured as mentioned above, the following effects can be obtained.

(1) It is possible to measure physical exercise condition data accurately and quantitatively for respective persons who the use the muscle force training machine, and the measured physical exercise condition data can be automatically stored in the measuring apparatus.

(2) It is possible to reduce a physical burden of a trainer or the like who increases and decreases a small amount of load finely, for example, in a load determination test, and a mental burden of worrying about a mistake. Particularly, since it is possible to calculate an appropriate load value and automatically change a load, a human data input mistake can be avoided, acquired data are consistent between systems for training and between persons who carryout training, and reliability for accumulating the data rises up.

(3) An individual physical exercise record, history, function evaluation and the like can be kept in a form of a data base (an accumulation of the data). Particularly, it is possible to easily make and print a written report which has taken a lot of trouble, and it is possible to widely reduce a clerical burden of the trainer or the like.

(4) The written report form can be made on the basis of a CGT operation record paper. Further, it is possible to make a radar chart which is easily understandable for general persons. In this case, the comprehensive geriatric training (CGT) means "comprehensive geriatric physical exercise training", and means a kinematic theory of a care and prevention program of Ministry of Health, Labour and Welfare.

(5) There is an advantage that it helps an overall judgment in accordance with the CGT such as a calculation of an appropriate value for the next time and after, decision of a training guiding principle for medical staff, setting of an individual training target and the like.

(6) Since it is possible to view a physical exercise condition data in relation to elapse of time of a stroke, it can be utilized for determination in a trial test of a different motion from a conventional pattern, an accidental condition in a painful section and the like.

DETAILED DESCRIPTION OF PREFERRED EMBODIMENT

A description will be given below of an embodiment for carrying out the present invention with reference to the accompanying drawings.

Figure 1:
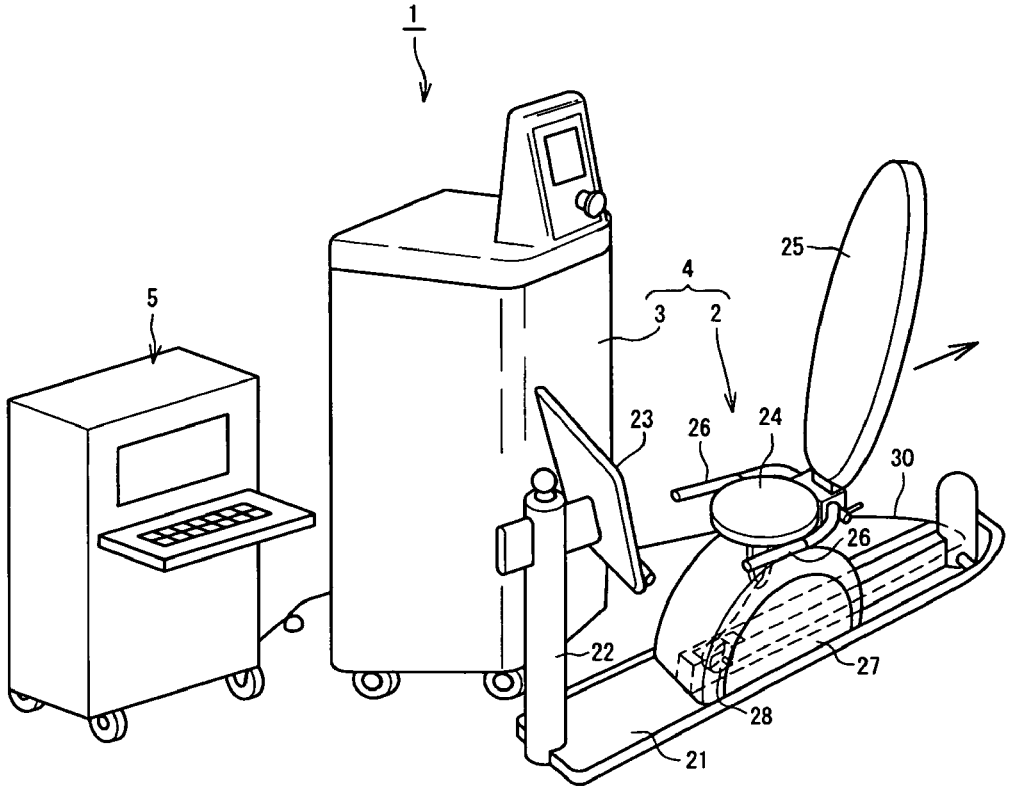
FIG. 1 is a perspective view showing a physical exercise condition detecting apparatus of a muscle force training machine in accordance with an embodiment of the present invention.

FIG. 1 is a perspective view showing a physical exercise condition detecting apparatus of a muscle force training machine in accordance with the embodiment of the present invention.

A physical exercise condition detecting apparatus 1 of a muscle force training machine in accordance with the embodiment of the present invention is constructed of a muscle force training machine 4 having a training apparatus main body 2 and a muscle force training load applying apparatus 3, and a measuring apparatus 5, as shown in FIG. 1. In the case in FIG. 1, the measuring apparatus 5 is shown as a separate body, however, may be integrated with the muscle force training load applying apparatus 3.

The training apparatus main body 2 is constructed of a base frame 21, a foot receiving plate 23 retained on an upper end of a support post 22 provided uprightly on one end of the base frame 21, and a movable carriage 27 attached to an upper portion of the base frame 21 so as to be movable in directions of coming close to and away from the foot receiving plate 23, and provided with a seat portion 24, a back rest portion 25 and both hands support arms 26 and 26 on a top portion, and is structured such that a distal end of a load transmitting cable body 30 in the muscle force training load applying apparatus 3 is led to the foot receiving plate 23 side through the movable carriage 27 from an opposite side to the foot receiving plate 23 in the training apparatus main body 2, and is turned back via a guide pulley 28 or the like so as to be fastened to the movable carriage 27.

The muscle force training load applying apparatus 3 is structured such as to apply a load to the movable carriage 27 of the training apparatus main body 2 via the load transmitting cable body 30.

Figure 2:
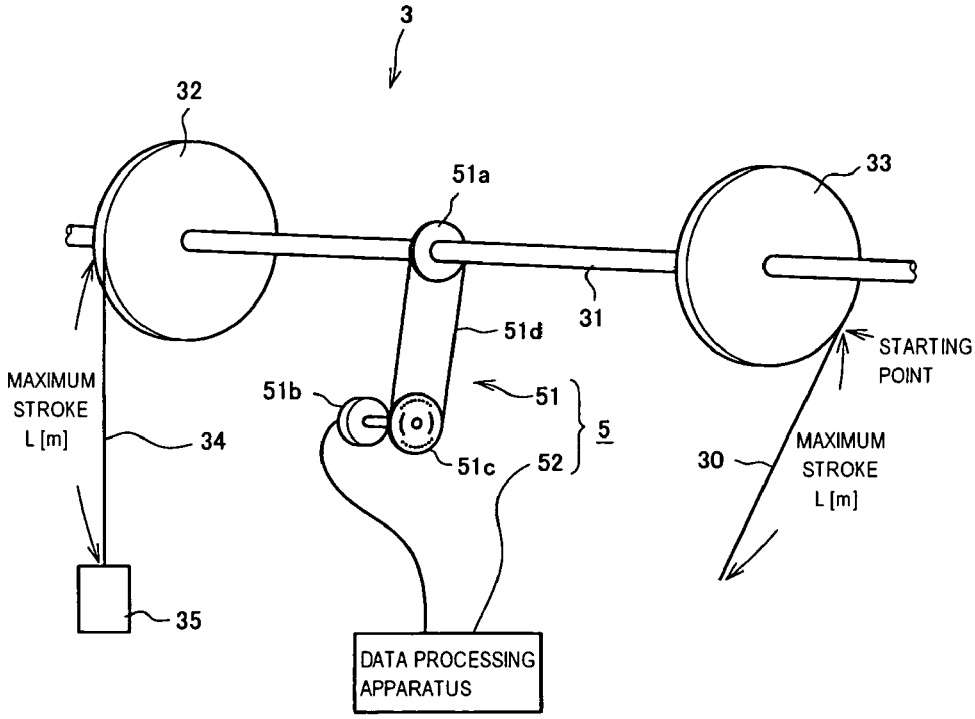
FIG. 2 is a perspective view showing an elemental structure of a load applying apparatus for a muscle force training, a rotation detecting sensor and a data processing, in the physical exercise condition detecting apparatus of the muscle force training machine in accordance with the embodiment of the present invention.

The data processing apparatus 5 takes in the data of a rotating direction and an amount of rotation of a main shaft of the muscle force training load applying apparatus 3, stores the taken in rotating direction and amount of rotation, together with the set data including at least an initial set load amount, various body condition information of a training person and other data necessary for measuring, as the physical exercise condition data in a data base, and processes them to make the physical exercise condition data as indicative data in forms of display data, print data and the like, on the basis of the various set data from the data base, FIG. 2 is a perspective view showing an elemental structure of the muscle force training load applying apparatus, a rotation detecting sensor and a data processing, in the physical exercise condition detecting apparatus of the muscle force training machine in accordance with the embodiment of the present invention.

In FIG. 2, the muscle force training load applying apparatus 3 is arranged horizontally within a base frame (not shown), is provided with a main shaft 31 which is supported rotatably in a vertical direction, a load weight pulley 32 which applies a load to the main shaft 31, a load transmitting pulley 33 which fastens a base end of the load transmitting cable body 30, is firmly attached to an end portion of the main shaft 31, and has the same diameter as that of the load weight pulley 32, and a load weight 35 which is connected to a distal end of a load weight coupling cable body 34 fastened to the load weight pulley 32 by its base end and wound in an opposite direction to the load transmitting cable body 30, and is structured such as to apply a load to the training apparatus main body 2 via the load transmitting cable body 30. In this case, a maximum stroke L [m] of the load transmitting cable body 30 is set to be the same length as a maximum stroke L [m] of the load weight coupling cable body 34. Further, "a starting point" of the load transmitting pulley 33 indicates a state in which a knee is fully bent, and the maximum stroke L [m] of the load transmitting cable body 30 indicates a state in which the knee is completely extended.

The measuring apparatus 5 is constructed of a rotation detecting sensor 51 which is provided in the vicinity of the main shaft 31 of the muscle force training load applying apparatus 3, and can detect a rotating direction and an amount of rotation of the main shaft 31, and a data processing apparatus 52 which takes in the rotating direction and the amount of rotation from the rotation detecting sensor 51, stores the taken in rotating direction and amount of rotation, together with set data including at least a load amount, various body condition information of a training person and other data necessary for measuring, as the physical exercise condition data in the data base, and processes them to make the physical exercise condition data as indicative data in forms of display data, print data and the like, on the basis of the various set data from the data base.

The rotation detecting sensor 51 is constructed of a pulley 51*a* which is provided on the main shaft 31 of the muscle force training load applying apparatus 3, an encoder 51*b* which can generate an A-phase pulse and a B-phase pulse which is phase-wise shifted at 90 degree from the A-phase pulse and can output pulses relating to the rotating direction and the amount of rotation, a pulley 51*c* which is provided on a rotating shaft of the encoder 51*b*, and a belt 51*d* which is wound between the pulley 51*a* and the pulley 51*c*, and is structured such as to detect the rotating direction and the amount of rotation of the main shaft 31 of the muscle force training load applying apparatus 3.

The encoder 51*b* is of an incremental type, outputs a pulse for each fixed amount of rotation of the rotating shaft of the rotation detecting sensor 51, and is structured such that the A-phase pulse and the B-phase pulse are output in the shifted timing (phase), and the pulses are output in such a manner that output timings of the A-phase pulse and the B-phase pulse have an inverse relationship between a clockwise rotation and a counterclockwise rotation of the shaft.

Figure 3:
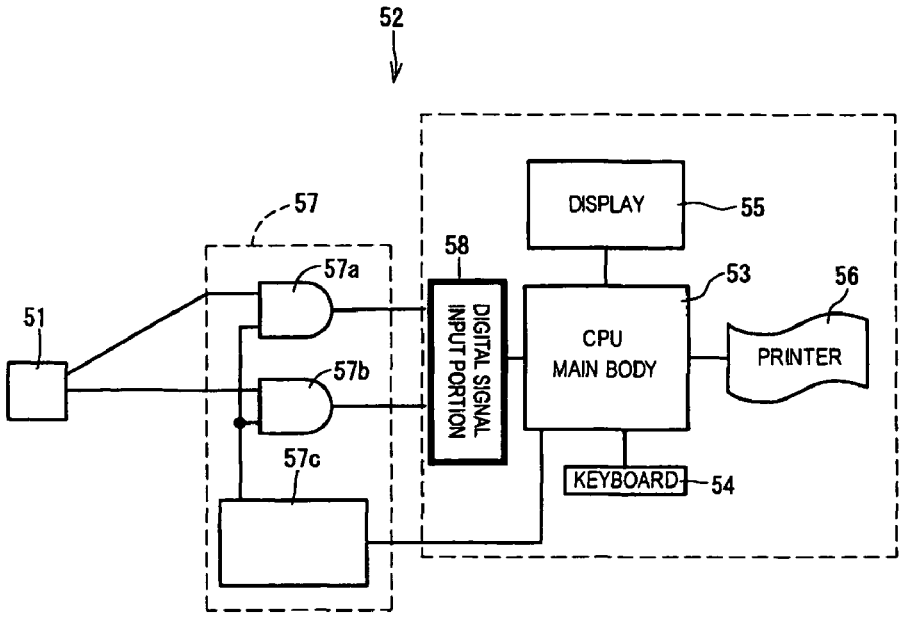
FIG. 3 is a block diagram showing a construction example of a data processing apparatus, in the physical exercise condition detecting apparatus of the muscle force training machine in accordance with the embodiment of the present invention.

FIG. 3 is a block diagram showing a construction example of the data processing apparatus, in the physical exercise condition detecting apparatus of the muscle force training machine in accordance with the embodiment of the present invention.

In FIG. 3, the data processing apparatus 52 is provided with a central processing unit main body (a CPU main body) 53 which has a data base as well as executing various processes, a keyboard 54 which gives various set data including at least an initially setting load amount, various body condition information (for example, training execution date and time, name, ID, date of birth, age, body height, body weight, BMI, blood pressure, heart rate, with or without arrhythmia, dosing medicine, personal wish and the like) of the training person, and the other data necessary for measuring (for example, an increased load amount) to the CPU main body 53, a display 55 which can display indicativedata (displaydata) relating to the physical exercise condition data obtained as a result of processing in the CPU main body 53, a printer 56 which prints indicative data (print data) relating to the physical exercise condition data obtained as the result of processing in the CPU main body 53, and a preprocessing circuit 57 which preprocesses the A-phase pulse and the B-phase pulse from the rotation detecting sensor 51 so as to give them to the CPU main body 53. In this case, reference numeral 58 denotes a digital signal input portion of the CPU main body 53, and the A-phase pulse and the B-phase pulse given from the preprocessing circuit 57 are input to the digital signal input portion 58.

The preprocessing circuit 57 is constructed of an A-phase gate 57*a*, a B-phase gate 57*b*, and a gate signal forming circuit 57*c*. One input terminal of the A-phase gate 57*a* is structured such that the A-phase pulse from the encoder 51*b* is input thereto. One input terminal of the B-phase gate 57*b* is structured such that the B-phase pulse from the encoder 51*b* is input thereto. The other input terminals of the A-phase gate 57*a* and the B-phase gate 57*b* are structured such that the gate signal is input thereto from the gate signal forming circuit 57*c*. Further, the gate signal of the gate signal forming circuit 57*c* is also given to the CPU main body 53. Respective output terminals of the A-phase gate 57*a* and the B-phase gate 57*b* are connected to a digital signal input portion 58 of the CPU main body 53, whereby the A-phase pulse is given to the digital signal input portion 58 from the output terminal of the A-phase gate 57*a*, and the B-phase pulse is given to the digital signal input portion 58 from the output terminal of the B-phase gate 57*b*, at a time when the gate signal from the gate signal forming circuit 57*c* is logic "1".

Although an illustration is omitted, the CPU main body 53 is provided with a central arithmetic processing portion which executes various arithmetic processing, a main memory which can store an operating system (OS), an application program for executing the processing of the present invention and various data, an input and output portion which gives data from the input apparatus such as the keyboard to the central arithmetic processing portion or the like, or gives the indicative data such as the display data or the print date processed in the central arithmetic processing portion to the output apparatus such as the display 55, and a hard disc apparatus which stores the OS, the application program for executing the present invention and the data base.

In the CPU main body 53, the OS and the application program for executing the present invention are developed in the main memory in this order from the hard disc apparatus, if a power supply is turned on, and the central arithmetic processing portion processes them, whereby the physical exercise condition detecting apparatus of the muscle force training machine in accordance with the present invention works.

Figure 4:
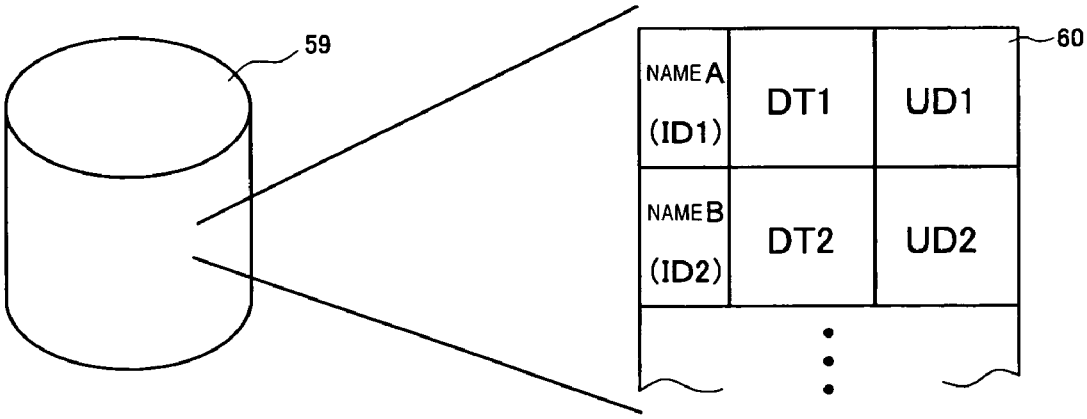
FIG. 4 is a view showing an example of a data base stored in a hard disc apparatus within the data processing apparatus, in the physical exercise condition detecting apparatus of the muscle force training machine in accordance with the embodiment of the present invention.

FIG. 4 is a view showing an example of the data base stored in the hard disc apparatus within the data processing apparatus, in the physical exercise condition detecting apparatus of the muscle force training machine in accordance with the embodiment of the present invention.

Reference numeral 59 denotes the hard disc apparatus schematically shown. The hard disc apparatus 59 is generally provided within the CPU main body 53, however, may be provided in an outer portion so as to be connected to the CPU main body 53, for example, in accordance with a USB connection, an LAN connection or the like.

The hard disc apparatus 59 is provided with a data base 60 as shown in FIG. 4. The data base 60 is an assembly of data recorded by combining set data, for example, name, ID or the like with other set data (training execution date and time, date of birth, age, body height, body weight, BMI, blood pressure, heart rate, with or without arrhythmia, dosing medicine, personal wish and the like).

The data are recorded in the data base 60, for example, in such a manner that other set data DT1 and physical exercise condition data UD1 of a person are stored on the basis of name A (or ID1) of the person, and other set data DT2 and physical exercise condition data UD2 of a person are stored on the basis of the name B (or ID2) of the person, . . . , respectively, as shown in FIG. 4. In this case, once the data are recorded in the data base 60, it is possible to output data DTn, . . . and physical exercise condition data UDn, . . . of a person on the basis of the name (or ID) of the person, in a form according to need at any time, under the control of the CPU main body 53. In this case, reference symbol n indicates that the data are those of the person having the name (or ID) on the basis of which output is demanded to the CPU main body 53.

In this case, the other set data DT1, DT2, . . . of the persons are, for example, such items as training execution date and time, date of birth, age, body height, body weight, BMI, blood pressure, heart rate, with or without arrhythmia, dosing medicine, personal wish, initially setting load and the like.

Further, the physical exercise condition data UD1 and UD2 at a time of training are the data which are computed by the CPU main body 53 on the basis of the A-phase pulse and the B-phase pulse output from the encoder 51*b* of the rotation detecting sensor 51, that is, the data which are recorded in accordance with passage of time.

Figure 5:
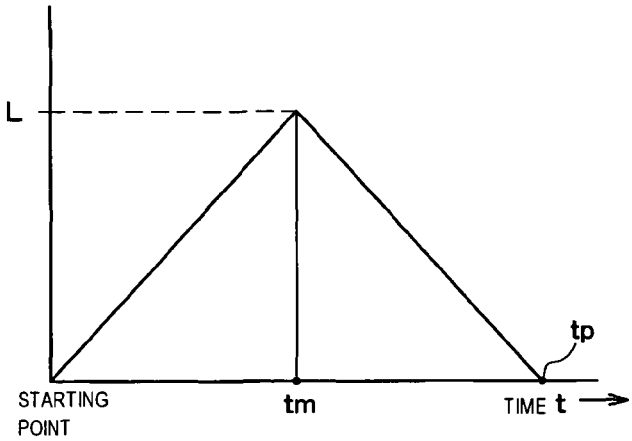
FIG. 5 is a view showing an example of data obtained by the data processing apparatus, in the physical exercise condition detecting apparatus of the muscle force training machine in accordance with the embodiment of the present invention.

FIG. 5 is a view showing an example of the data obtained by the data processing apparatus, in the physical exercise condition detecting apparatus of the muscle force training machine in accordance with the embodiment of the present invention, where a time t is set to a horizontal axis, and a count value of the encoder 51*b* is set to a vertical axis.

First of all, a load is set to the muscle force training load applying apparatus 3, the training apparatus main body 2 is set to be capable of training, and a power supply of the measuring apparatus 5 is turned on so as to get ready to measure.

Further, a measurable state is achieved by storing the various set data of the person who executes the muscle force training (the initial set load amount, the various body condition information of the training person, and the other data necessary for measuring) in the data base 60 via the CPU main body 53.

In this case, the various body condition information of the training person means, for example, training execution date and time, name, ID, date of birth, age, body height, body weight, BMI, blood pressure, heart rate, with or without arrhythmia, dosing medicine, personal wish and the like.

Further, the other data necessary for measuring means, for example, the load amount increased from the original setting amount, other data necessary for measuring, and the like.

In the case that the necessary information has been already stored in the date base 60, the measurable state can be achieved by inputting the name (or ID) or the like to the CPU main body 53.

Then, the person executing the muscle force training sits on the seat portion 24 of the training apparatus main body 2, leans its back against the back rest portion 25, holds the support arms 26 and 26 by both hands, and puts its feet on the foot receiving plate 23 in a state in which the knees are fully bent. This state corresponds to "starting point" shown in FIGS. 3 and 5.

Further, if the knees are extended progressively, the load transmitting cable body 30 of the muscle force training load applying apparatus 3 is pulled, the load transmitting pulley 33 is rotated, and the main shaft is rotated. Accordingly, the rotating force is transmitted to the pulley 51*a*, the belt 51*d* and the pulley 51*c*, and the A-phase pulse and the B-phase pulse are output at a predetermined timing by the encoder 51*b*. The A-phase pulse is input to the A-phase gate 57*a*, and the B-phase pulse is input to the B-phase gate 57*b*, respectively. At this time, since the other input terminals of the A-phase gate 57*a* and the B-phase gate 57*b* are set to logic "1", the A-phase pulse and the B-phase pulse pass through the A-phase gate 57*a* and the B-phase gate 57*b*, and are input to the CPU main body 53 via the digital signal input portion 58. The CPU main body 53 determines addition from a state of the timings (the phases) of the A-phase pulse and the B-phase pulse, and counts the pulses. Further, the CPU main body 53 stores the count values together with the times in the data base 60. This state is stored as a state in which the count value rises according to elapse of time t in the data base 60 ("starting point" to time tm), as shown in FIG. 5.

If the knees come to a completely extended state, the count value comes to a state of the maximum value, as shown in FIG. 5.

Next, the knees are bent progressively, the load transmitting cable body 30 is pulled into the muscle force training load applying apparatus 3 on the basis of the load weight 35 provided in the distal end of the load weight coupling cable body 34 of the load weight pulley 32 of the muscle force training load applying apparatus 3, the load transmitting pulley 33 is reversely rotated, and the main shaft 31 is reversely rotated. Accordingly, the rotating force is transmitted to the pulley 51*a*, the belt 51*d* and the pulley 51*c*, and the A-phase pulse and the B-phase pulse are output by the encoder 51*b* at a reverse timing (phase) to the timing at which the load transmitting cable body is pulled out of the muscle force training load applying apparatus 3. The A-phase pulse is input to the A-phase gate 57*a*, and the B-phase pulse is input to the B-phase gate 57*b*, respectively. At this time, since the other input terminals of the A-phase gate 57*a* and the B-phase gate 57*b* are set to the logic "1", the A-phase pulse and the B-phase pulse pass through the A-phase gate 57*a* and the B-phase gate 57*b*, and are input to the CPU main body 53 via the digital signal input portion 58. Since the A-phase pulse and the B-phase pulse are in the state of the reverse timing to the timing at which the load transmitting cable body is pulled out of the muscle force training load applying apparatus 3, the CPU main body 53 determines subtraction, and counts so as to subtract from the maximum value on the basis of the pulses. Further, the CPU main body 53 stores the subtraction count values together with the times in the data base 60. This state is stored as a state in which the count value is reduced from the maximum value in accordance with elapse of time t in the data base 60 (time tm to time tp), as shown in FIG. 5.

Further, the physical exercise condition data stored in the data base 60 can be displayed on the display 55 via the CPU main body 53 and can be printed via the printer 56 whenever the need arises.

As mentioned above, in accordance with the physical exercise condition detecting apparatus of the muscle force training machine on the basis of the present invention, the following advantages can be obtained.

(1) It is possible to measure physical exercise condition data accurately and quantitatively for respective persons who use the muscle force training machine 4, and to store the measured physical exercise condition data automatically in the measuring apparatus 5.

(2) It is possible to reduce a physical burden of a trainer or the like who increase and decrease a small amount of load finely, for example, in a load determination test and the like, and a mental burden of worrying about a mistake. Particularly, since it is possible to calculate an appropriate load value and automatically change a load, a human data input mistake can be avoided, acquired data are consistent between systems for training and between persons who carry out training, and reliability for accumulating the data rises up.

(3) An individual physical exercise record, history, function evaluation and the like can be kept in a form of a data base (an accumulation of the data). Particularly, it is possible to easily make and print a written report which has taken a lot of trouble, and it is possible to widely reduce a clerical burden of the trainer or the like.

(4) The written report form can be made on the basis of a CGT operation record paper. Further, it is possible to make a radar chart which is easily understandable for general persons. In this case, the comprehensive geriatric training (CGT) means "comprehensive geriatric physical exercise training", and means a kinematic theory of a care and prevention program of Ministry of Health, Labour and Welfare.

(5) There is an advantage that it helps an overall judgment in accordance with the CGT such as a calculation of an appropriate value for the next time and after, decision of a training guiding principle for medical staff, setting of an individual training target and the like.

(6) Since it is possible to view a physical exercise condition data in relation to elapse of time of a stroke, it can be utilized for determination in a trial test of a different motion from a conventional pattern, an accidental condition in a painful section and the like.

EXAMPLE

In the above-mentioned embodiment for carrying out the invention, only the element structure of the muscle force training load applying apparatus 3 is shown. Then, a description will be given in the present example by showing one specific construction example about the muscle force training load applying apparatus 3.

Figure 6:
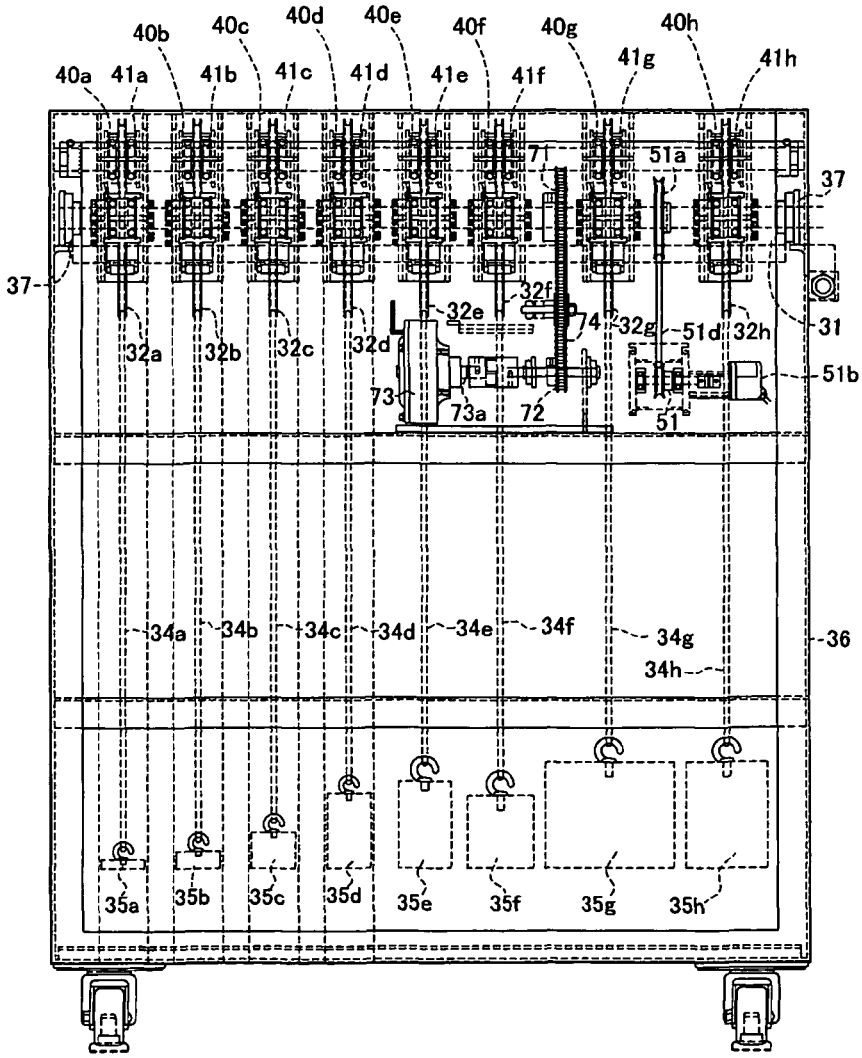
FIG. 6 is a front view showing one construction example of the load applying apparatus for the muscle force training used in the embodiment of the present invention in a partly omitted manner.
Figure 7:
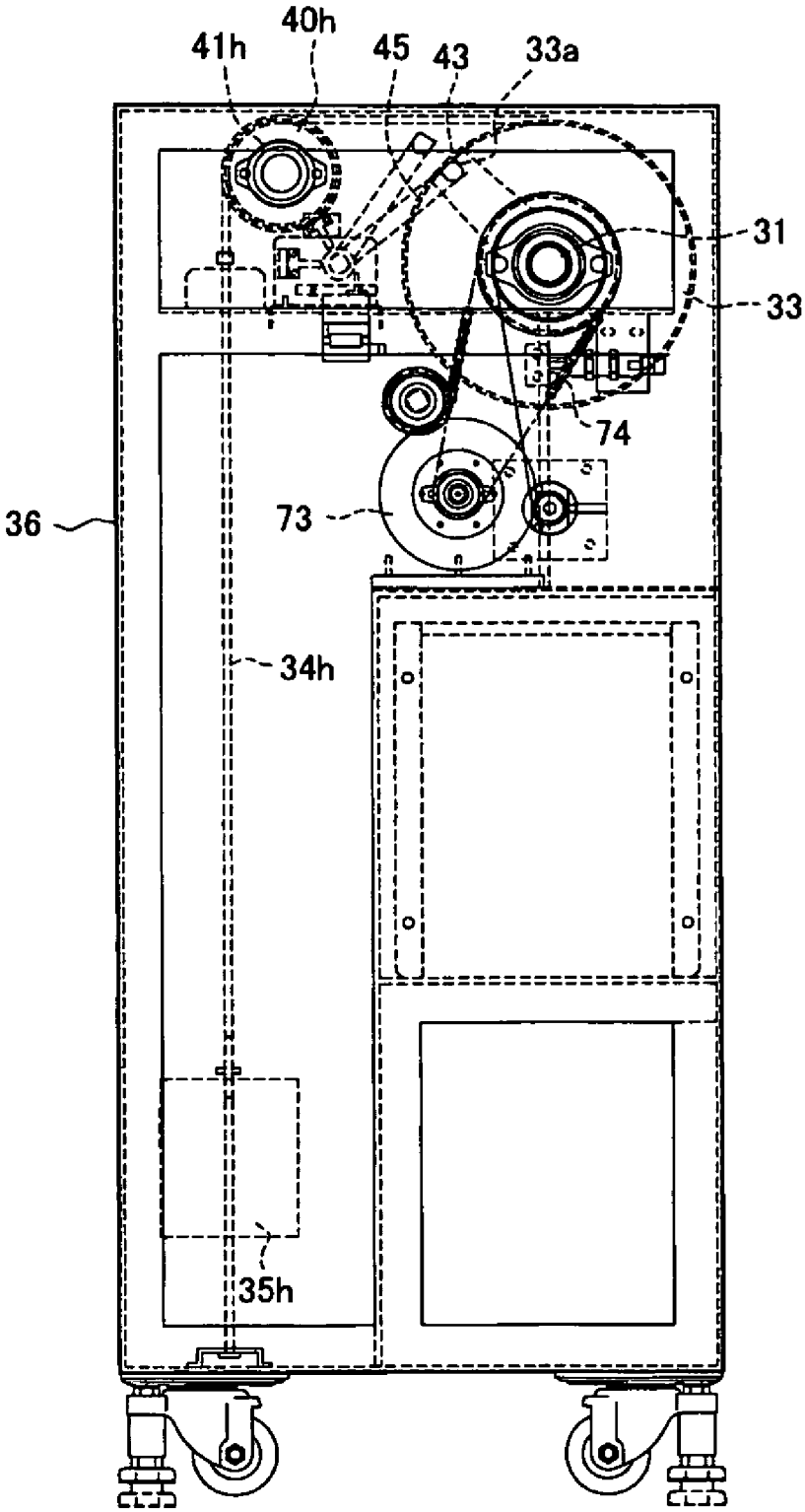
FIG. 7 is a side view showing the one construction example of the load applying apparatus for the muscle force training used in the embodiment of the present invention.
Figure 8:
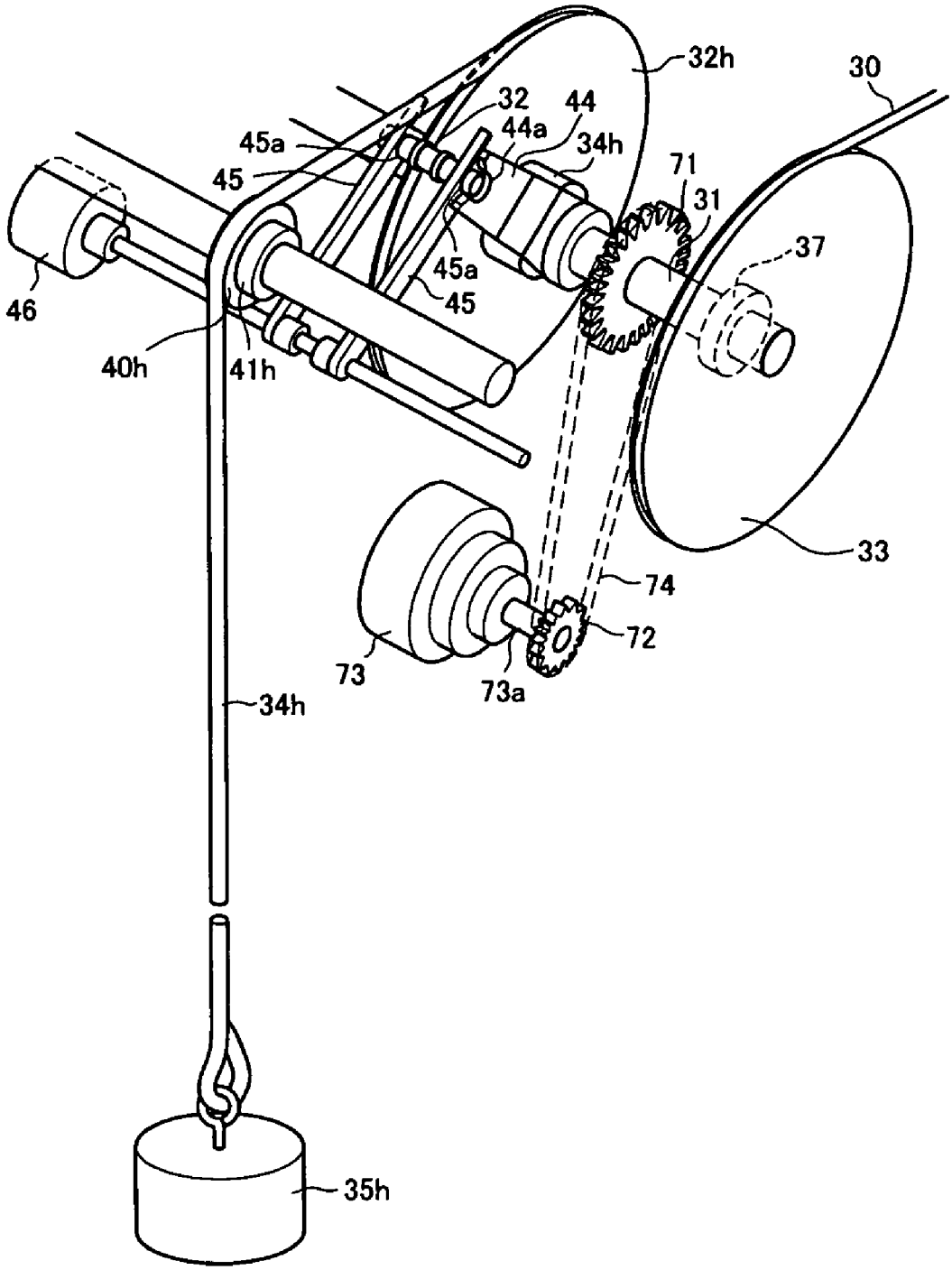
FIG. 8 is a schematic view of a substantial part of the load applying apparatus for the muscle force training used in the embodiment of the present invention.
Figure 9:
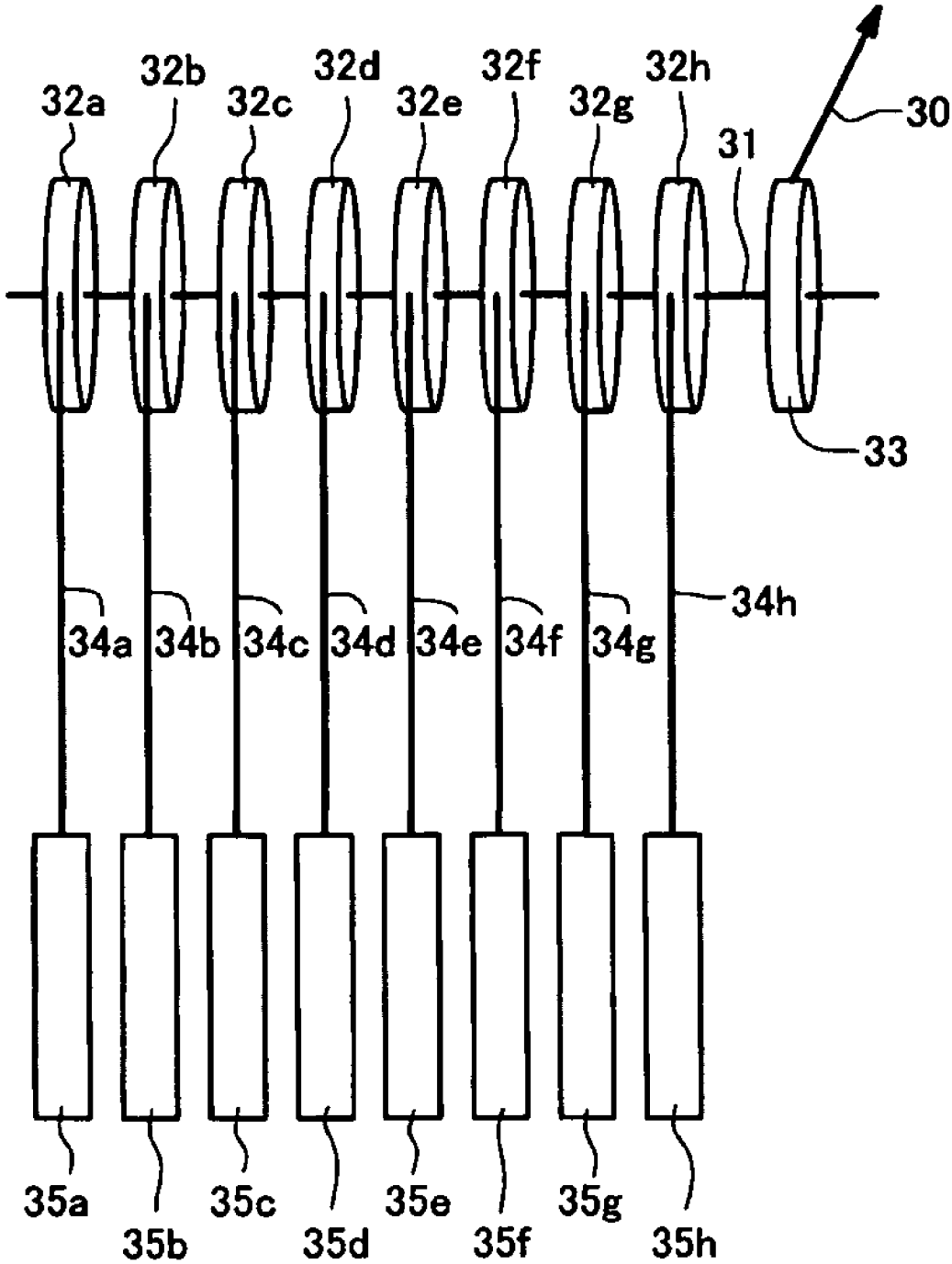
FIG. 9 is a principle explanatory view of the load applying apparatus for the muscle force training used in the embodiment of the present invention.

FIG. 6 is a front view showing the muscle force training load applying apparatus in accordance with the example of the present invention in a partly omitted manner, FIG. 7 is a side view of the same, FIG. 8 is a schematic view of a substantial part of the present invention, and FIG. 9 is a principle explanatory view of the present invention.

In the figures, reference numeral 36 denotes a box-shaped base frame. Reference numeral 31 denotes a main shaft which is arranged horizontally within the base frame 1, and is supported rotatably in a vertical direction. Further, reference numerals 37 and 37 denote a bearing of the main shaft 31 provided in the base frame 36.

Reference symbols 32*a*, 32*b*, 32*c*, 32*d*, 32*e*, 32*f*, 32*g* and 32*h* denote load weight pulleys which are arranged at a predetermined distance on the main shaft 31, and are attached in a rotatable state with respect to the main shaft 31. Further, the load weight pulleys 32*a*, 32*b*, 32*c*, 32*d*, 32*e*, 32*f*, 32*g* and 32*h* are provided with coupling pin receiving concave portions 32*aa*, 32*ba*, 32*ca*, 32*da*, 32*ea*, 32*fa*, 32*ga* and 32*ha* at one positions of their circumferential surfaces respectively, where the coupling pins will be described below. In this case, the coupling pin receiving concave portions 32*aa*, 32*ba*, 32*ca*, 32*da*, 32*ea*, 32*fa*, 32*ga* and 32*ha* are omitted in the drawing. Further, the number of the load weight pulleys 32*a*, 32*b*, 32*c*, 32*d*, 32*e*, 32*f*, 32*g* and 32*h* is set to eight in correspondence to the number of the load weights in the present example. Further, reference symbols 39*a*, 39*b*, 39*c*, 39*d*, 39*e*, 39*f* and 39*h* denote bearings provided between the load weight pulleys 32*a*, 32*b*, 32*c*, 32*d*, 32*e*, 32*f*, 32*g* and 32*h* and the main shaft 31.

Reference numeral 33 denotes a load transmitting pulley. The load transmitting pulley 33 is a pulley which fastens the base end of the load transmitting cable body 30, is firmly attached to the end portion of the main shaft 31, and has the same diameter as those of the load weight pulleys 32*a*, 32*b*, 32*c*, 32*d*, 32*e*, 32*f*, 32*g* and 32*h*.

Reference symbols 35*a*, 35*b*, 35*c*, 35*d*, 35*e*, 35*f*, 35*g* and 35*h* denote load weights having different weights. In the present example, the weight of the lightest load weight 35*a* is set to 0.25 [kg], the weight of the load weights 35*b*, 35*c*, 35*d*, 35*e*, 35*f*, 35*g* and 35*h* are set to a sequence of weights obtained by multiplying the weight of the load weight 35*a* by two and its powers, and the load weights are constructed of eight load weights in total. The weights of the load weights are as follows, in the present example. The load weight 35*a* is 0.25 [kg], the load weight 35*b* is 0.5 [kg], the load weight 35*c* is 1 [kg], the load weight 35*d* is 2 [kg], the load weight 35*e* is 4 [kg], the load weight 35*f* is 8 [kg], the load weight 35*g* is 16 [kg], and the load weight 35*h* is 32 [kg]. In accordance with the combination of the load weights, the load can be set in 0.25 [kg] steps in a range between 0 and 63.75 [kg]. In other words, the load can be set in accordance with 255 ways. Further, these load weights 35*a*, 35*b*, 35*c*, 35*d*, 35*e*, 35*f*, 35*g* and 35*h* are connected to the distal ends of the load weight coupling cable bodies 34*a*, 34*b*, 34*c*, 34*d*, 34*e*, 34*f*, 34*g* and 34*h* which are fastened by their base ends to the load weight pulleys 32*a*, 32*b*, 32*c*, 32*d*, 32*e*, 32*f*, 32*g* and 32*h*, respectively, and wound in the opposite direction to the load transmitting cable body 21.

Further, in the case that the load weight of the minimum unit mentioned above is set to 0.2 [kg], a sequence of weights obtained by multiplying it by two and its powers are 0.4 [kg], 0.8 [kg], 1.6 [kg], 3.2 [kg], 6.4 [kg], 12.8 [kg] and 25.6 [kg].

Further, reference symbols 40*a*, 40*b*, 40*c*, 40*d*, 40*e*, 40*f*, 40*g* and 40*h* denote guide pulleys which are supported rotatably at front portions of the load weight pulleys 32*a*, 32*b*, 32*c*, 32*d*, 32*e*, 32*f*, 32*g* and 32*h*, and around which parts of the load weight coupling cable bodies 34*a*, 34*b*, 34*c*, 34*d*, 34*e*, 34*f*, 34*g* and 34*h* are wound. In this case, reference symbols 41*a*, 41*b*, 41*c*, 41*d*, 41*e*, 41*f*, 41*g* and 41*h* denote bearings of the guide pulleys 40*a*, 40*b*, 40*c*, 40*d*, 40*e*, 40*f*, 40*g* and 40*h*.

Reference numerals 42, 42, 42, 42, 42, 42, 42 and 42 denote coupling arms which are firmly attached at close positions of the respective load weight pulleys 32*a*, 32*b*, 32*c*, 32*d*, 32*e*, 32*f*, 32*g* and 32*h* on the main shaft 31 so as to be rotated integrally with the main shaft 31, and are provided with the coupling pin receiving concave portions 42*a* in their respective distal ends, where the coupling pins will be described below. In the drawing, there is shown only the coupling arm 42 forming a pair with the load weight pulley 32*h*.

Reference numerals 43, 43, 43, 43, 43, 43, 43 and 43 denote coupling pins. The coupling pins 43, 43, 43, 43, 43, 43, 43 and 43 can enter into or be taken out of the coupling pin receiving concave portions 32*aa*, 32*ba*, 32*ca*, 32*da*, 32*ea*, 32*fa*, 32*ga* and 32*ha* in the load weight pulleys 32*a*, 32*b*, 32*c*, 32*d*, 32*e*, 32*f*, 32*g* and 32*h*, and coupling pin receiving concave portions 44*a* of coupling arms 44, 44, 44, 44, 44, 44, 44 and 44.

Reference numerals 45, 45, 45, 45, 45, 45 and 45 denote coupling pin delivering arms. The coupling pin delivering arms 45, 45, 45, 45, 45, 45, 45 and 45 are arranged in front of the respective load weight pulleys 32*a*, 32*b*, 32*c*, 32*d*, 32*e*, 32*f*, 32*g* and 32*h*, and are provided with receiving concave portions 43*a* of the coupling pins 43 at their distal ends. The coupling pin delivering arms 45, 45, 45, 45, 45, 45, 45 and 45 are constructed of sets of two arms located at the both sides of the load weight pulleys 32, 32*b*, 32*c*, 32*d*, 32*e*, 32*f*, 32*g* and 32*h* respectively. Further, the coupling pin delivering arms 45, 45, 45, 45, 45, 45, 45 and 45 are rotated at a predetermined stroke in a vertical direction by motors 46, 46, 46, 46, 46, 46, 46 and 46 respectively. Further, the coupling pin delivering arms 45, 45, 45, 45, 45, 45, 45 and 45 are structured such as to enter and take the coupling pins 43 into and out of the coupling pin receiving concave portions 32*aa*, 32*ba*, 32*ca*, 32*da*, 32*ea*, 32*fa*, 32*ga* and 32*ba* in the load weight pulleys 32*a*, 32*b*, 32*c*, 32*d*, 32*e*, 32*f*, 32*g* and 32*h* and the coupling pin receiving concave portions 44*a* in the coupling arms 44, 44, 44, 44, 44, 44, 44 and 44 at a time when they come into line at their rotation starting end positions. In this case, the motors 46, 46, 46, 46, 46, 46, 46 and 46 are respectively driven by pressing operations of operation buttons (not shown) provided at appropriate positions of the base frame 36.

Further, a shock absorber (not shown) is provided in the vicinity of the load transmitting pulley 33. The shock absorber is provided in such a manner as to absorb a shock just before the load transmitting pulley 33 comes back to the rotation starting end position. The shock absorber is constructed of a shock absorber main body which is firmly attached to the base frame 36, and a pressing plate which comes into contact with and away from a control lever of the shock absorber main body and is firmly attached to the load transmitting pulley 33.

Reference numeral 71 denotes a driven sprocket which is firmly attached to the main shaft 31, reference numeral 72 denotes a driving sprocket which is firmly attached to a rotating shaft 73*a* of a motor 73 fixed to the base frame 36, and reference numeral 74 denotes a chain which is wound between the driving sprocket 72 and the driven sprocket 71.

Next, a description will be given of setting change of a load on the basis of the combination of the load weights.

In order to set an appropriate load for a training person, the appropriate load is achieved on the basis of a combination of the load weights 35*a*, 35*b*, 35*c*, 35*d*, 35*e*, 35*f*, 35*g* and 35*f*, and the combination is achieved by selecting the load weights to be used. In this case, only the selected load weighs are coupled to the main shaft 31, and this is achieved by coupling the load weight pulleys, to which the base ends of the load weight coupling cable bodies having the selected load weights are fastened, to the main shaft 31.

In this case, the rotation detecting sensor 51 of the measuring apparatus 5 provided in the inner portion of the muscle force training load applying apparatus 3 is constructed of the pulley 51*a* which is rotatably fixed to the main shaft 31, the encoder 51*b* which outputs the A-phase pulse and the B-phase pulse, the pulley 51*c* which is provided on the rotating shaft of the encoder 51*b*, and the belt 51*d* which is wound between the pulley 51*a* and the pulley 51*c*.

In practice, a load is applied to the training apparatus main body 2 by the muscle force training load applying apparatus 3 having the structure mentioned above.

DESCRIPTION OF REFERENCE NUMERALS

1 physical exercise condition detecting apparatus of muscle force training machine
2 training apparatus main body
3 muscle force training load applying apparatus
4 muscle force training machine
5 measuring apparatus
21 base frame
22 support post
23 foot receiving plate
24 seat portion
25 back rest portion
31 main shaft
32 load weight pulley
33 load transmitting pulley
34 load weight coupling cable body
35 load weight
51 rotation detecting sensor
52 data processing apparatus
53 CPU main body
57 preprocessing circuit

What is claimed is:

1. A physical exercise condition detecting apparatus of a muscle force training machine comprising:

a training apparatus main body; and a training load applying apparatus having a main shaft which is arranged horizontally within a base frame and is supported rotatably in a vertical direction, load weight pulleys which apply a load to said main shaft, a load transmitting pulley which fastens a base end of a load transmitting cable body, is firmly attached to an end portion of said main shaft and has the same diameter as those of said load weight pulleys, and load weights which are connected to respective distal ends of load weight coupling cable bodies, fastened by their base ends to said load weight pulleys and wound in an opposite direction to said load transmitting cable body, and applying a load to the training apparatus main body via the load transmitting cable body, wherein the physical exercise condition detecting apparatus comprises:

a rotation detecting sensor which is provided in the vicinity of the main shaft within said training load applying apparatus, and is capable of detecting a rotating direction and an amount of rotation of said main shaft; and a data processing apparatus which takes in the rotating direction and the amount of rotation from said rotation detecting sensor, stores said taken in rotating direction and amount of rotation, together with set data at least including a load amount, various body condition information of a training person and other data necessary for measuring, in a data base, and processes them to make indicative data in forms of display data, print data and the like on the basis of the various set data from said data base.

* * * * *